US007795192B2

(12) United States Patent
Svarcas et al.

(10) Patent No.: US 7,795,192 B2
(45) Date of Patent: Sep. 14, 2010

(54) LUBRICANT COMPOSITION SUITABLE FOR DIRECT FUEL INJECTED, CRANKCASE-SCAVENGED TWO-STROKE ENGINES

(75) Inventors: Laimute R. Svarcas, Wickliffe, OH (US); William K. S. Cleveland, Mentor-on-the-Lake, OH (US); John L. Petric, Kirtland, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 969 days.

(21) Appl. No.: 10/511,247

(22) PCT Filed: Apr. 17, 2003

(86) PCT No.: PCT/US03/11955

§ 371 (c)(1), (2), (4) Date: Oct. 13, 2004

(87) PCT Pub. No.: WO03/089555

PCT Pub. Date: Oct. 30, 2003

(65) Prior Publication Data

US 2005/0130856 A1 Jun. 16, 2005

Related U.S. Application Data

(60) Provisional application No. 60/373,988, filed on Apr. 19, 2002.

(51) Int. Cl.
*C10M 169/04* (2006.01)
*C10M 159/16* (2006.01)
*C10M 133/16* (2006.01)

(52) U.S. Cl. ..... 508/454; 508/287; 508/551; 508/554; 508/542; 508/563

(58) Field of Classification Search ..... 508/287, 508/454, 551, 554, 542; 44/58, 75, 73, 330, 44/427

See application file for complete search history.

(56) References Cited

U.S. PATENT DOCUMENTS

| | | | | |
|---|---|---|---|---|
| 3,772,359 | A | 11/1973 | Schlobohm et al. | |
| 4,025,316 | A | 5/1977 | Stover | |
| 4,320,020 | A | 3/1982 | Lange et al. | |
| 4,425,138 | A | 1/1984 | Davis | |
| 4,663,063 | A | 5/1987 | Davis | |
| 4,705,643 | A | 11/1987 | Nemo | |
| 4,708,809 | A | 11/1987 | Davis | |
| 4,724,091 | A | 2/1988 | Davis | |
| 5,264,005 | A * | 11/1993 | Blythe | 44/388 |
| 6,193,767 | B1 | 2/2001 | Arters et al. | |
| 6,242,394 | B1 * | 6/2001 | Chamberlin, III | 508/549 |
| 6,348,075 | B1 | 2/2002 | Jackson | |
| 6,391,833 | B1 * | 5/2002 | Ilmain et al. | 508/518 |
| 6,458,172 | B1 | 10/2002 | Macduff et al. | |

FOREIGN PATENT DOCUMENTS

WO 93 03120 2/1993

OTHER PUBLICATIONS

Johnson et al., SAE Technical Paper 980756 (from 1998 SAE Paper SP-1327), Feb. 1998, "Electronic Direct Fuel Injection System applied to an 1100 cc Two-Stroke Personal Watercraft Engine."

Sawada et al., SAE Technical Paper 980761 (from 1998 SAE Paper SP-1327), Feb. 1998, "Development of a Low Emission Two-Stroke Cycle Engine."

* cited by examiner

*Primary Examiner*—Ellen M McAvoy
*Assistant Examiner*—Vishal Vasisth
(74) *Attorney, Agent, or Firm*—David M. Shold; Christopher D. Hilker

(57) ABSTRACT

A lubricant composition suitable for lubricating a direct fuel injection two-stroke engine comprises at least one condensation product of a fatty acid with an amine or ammonia and of at least one Mannich dispersant, each in an amount of 0.5 to 8 percent by weight, along with an oil of lubricating viscosity.

10 Claims, No Drawings

LUBRICANT COMPOSITION SUITABLE FOR DIRECT FUEL INJECTED, CRANKCASE-SCAVENGED TWO-STROKE ENGINES

CROSS-REFERENCE TO RELATED APPLICATION

This application claims priority from a 371 of PCT/US03/11955, filed Apr. 17, 2003 which claims benefit of U.S. Provisional Application 60/373,988, filed Apr. 19, 2002.

BACKGROUND OF THE INVENTION

The present invention relates to lubricant compositions and fuel-lubricant mixtures useful in direct fuel injected, crankcase-scavenged two-stroke engines. The use of spark ignited two-stroke internal combustion engines rapidly increased during the last three decades of the twentieth century. This growth, however, has now tapered off, mainly due to the high emissions levels present in these conventional two-stroke engines. The current global population of conventional two-stroke engines is very large, numbering in the tens of millions. Because these two-stroke engines are cost-effective and have high power to weight ratios, they are very commonly used in lawn and garden equipment, portable contractor equipment, such as pumps and electrical generators, low-cost transportation vehicles, such as mopeds, as well as commercial and recreational vehicles including motorcycles, outboard engines, snowmobiles, personal watercraft vehicles and the like.

The increasing need to reduce emissions in these two-stroke engines, especially the larger engines in outboards, snowmobiles, personal watercraft and the like, has led to the incorporation of direct fuel injected technology, where the standard carbureted or electronic fuel injected two-stroke engines are replaced with the new two-stroke direct fuel injection (DFI) engine designs (1998 SAE paper SP-1327). These new DFI engines reduce emissions by directly injecting the fuel into the combustion chamber after the exhaust port is closed, thus eliminating the "short-circuiting" of the fuel/oil mixture, which can be as high as 30%. Since in most two-stroke engines the amount of oil supplied for lubrication is proportional to the fuel consumed, a 30% reduction in fuel consumption may result in a similar reduction of oil for lubrication. This increase in fuel efficiency and the commensurate reduction in fuel flow results in higher operating temperatures, since the cooling effect of excess fuel and air flow is eliminated.

The net result of applying DFI technology to two-stroke engines is that fuel efficiency is improved and emissions are reduced, while maintaining the power density and performance of a conventional two-cycle engine. The challenge is to provide lubricants which will give adequate engine protection at higher operating temperatures and lower oiling rates than the conventional two-stroke engines. Commercial experience over the past few years has demonstrated that many conventional two-stroke oils do not provide adequate performance and protection for this new generation of DFI engines. This lack of oil performance has lead to problems such as scuffing, ring sticking, carbon buildup, power loss, increased emissions, and in some cases, catastrophic engine failure. Carbon build up in the ring grooves is especially prevalent in these engines and causes "ring jacking," which leads to scuffing and subsequent engine seizure. Ring groove fill ratings, therefore, are an essential measure of differentiating oil performance.

The original equipment manufacturers (OEMs) have addressed some of these problems with engineering solutions, which include special coatings and metallurgy for rings and cylinder walls, redesigned flow and distribution patterns for the fuel, enhanced cooling systems, as well as special injectors for the fuel or fuel/air mixture. These engineering enhancements have reduced but not eliminated the need for special two-stroke lubricants. The design of these special lubricants and their ability to address these problems is further restricted by the fact that these lubricants must burn cleanly. Traditional solutions, such as using higher viscosity lubricants to eliminate scuffing and seizure, may create other problems, such as increased carbon and varnish deposition. Increased deposits lead to problems including spark plug fouling, pre-ignition and ring sticking, which can cause compression loss and subsequent engine failure.

Another traditional solution would be the use of high dosages of nitrogen containing compounds or normal dosages of high-nitrogen compounds. Examples of these solutions would be two widely used OEM oils, designated herein as OEM Oils A and B, which have nitrogen content greater than 0.8% and 1.0% respectively. Although these high-nitrogen packages provide some benefit in the engine, that benefit is mitigated by contributing to heavy carbon deposition in the ring groove area, which then causes ring jacking and subsequent engine seizure.

Some of the problems associated with DFI two-stroke engines have been addressed by including additives commonly associated with four-stroke gasoline and diesel engines; i.e., using zinc dialkyl dithiophosphate (ZDDP) to prevent scuffing and scoring. These traditional additives contain high levels of ash and sulfur/phosphorus chemistry, which are known to cause problems with pre-ignition and deposits. Experience with these problems and some of the attempted solutions support the belief that DFI two-stroke engines benefit from the use of specially formulated lubricants.

The present invention, therefore, describes lubricant formulations that address the special needs of DFI two-stroke engines by maintaining a high level of engine cleanliness and durability at low levels of ash and nitrogen. The low-ash, low-nitrogen formulations described below significantly reduce ring groove fill and heavy carbon deposition, thus eliminating ring jacking and subsequent engine seizure. As a result, these new formulations provide improved engine durability.

SUMMARY OF THE INVENTION

The present invention provides a lubricant composition suitable for lubricating a direct fuel injection two-stroke engine, comprising:

(a) at least 40 percent by weight of an oil of lubricating viscosity;

(b-1) 0.5 to 8 percent by weight of at least one condensation product of a fatty hydrocarbyl monocarboxylic acylating agent with an amine or ammonia, and (b-2) 0.5 to 8 percent by weight, based on the lubricant composition, of at least one Mannich dispersant;

(c) 0 to 45 percent by weight of a combustible solvent having a viscosity of less than 2 $mm^2s^{-1}$ (cSt) at 100° C.; and (d) 0 to 3 percent by weight of an antioxidant;

provided that the total amount of (b-1) plus (b-2) plus any dispersants in the lubricant composition other than (b-1) and (b-2) is at least about 1.5 percent by weight, further provided that the total nitrogen content in the lubricant composition is about 0.25 to about 0.75 percent by weight.

The present invention further provides a fuel-lubricant composition comprising the above lubricant composition admixed with a major amount of a liquid fuel composition.

It further provides a method of lubricating a direct fuel injection two-cycle engine, comprising supplying the lubricant composition to the engine. The lubricant can be supplied in admixture with a liquid fuel composition.

DETAILED DESCRIPTION OF THE INVENTION

The present invention provides a composition suitable for lubricating direct fuel injection two-stroke engines containing a mixture of dispersants, wherein the total nitrogen content in the lubricant is 0.25-0.75%.

The Oil of Lubricating Viscosity

A first component of the present invention is an oil of lubricating viscosity, including natural or synthetic lubricating oils and mixtures thereof. Specific examples of the oils of lubricating viscosity are described in U.S. Pat. No. 4,326,972.

The oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from $C_5$ to $C_{12}$ monocarboxylic acids and polyols or polyol ethers.

Other synthetic lubricating oils include liquid esters of phosphorus-containing acids, polymeric tetrahydrofurans, silicon-based oils such as the polyalkyl-, polyaryl-, polyalkoxy-, or polyaryloxy-siloxane oils, and silicate oils. Hydrotreated naphthenic oils are also known and can be used, as well as oils prepared by a Fischer-Tropsch gas-to-liquid synthetic procedure.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The kinematic viscosity of the oil of lubricating viscosity is typically greater than 2.0 $mm^2s^{-1}$ (cSt) at 100° C., and often greater than 3, 4, or 5 $mm^2s^{-1}$.

The lubricating oil in the invention will normally comprise at least 40 percent by weight of the composition, preferably at least 50% by weight of the composition. For purposes of calculating the total amount of lubricating oil, the amounts of diluent oil customarily present in the additive components commercially supplied, which is often up to 50% or more will be counted toward the total amount of lubricating oil. Thus, for example, a formulation containing 48% oil (added as such) and 11.6% of various additives each containing 34-40% oil, may contain a total of 48+4.3 or 52.3% oil.

The Dispersants

The invention also contains at least two specified dispersants, and optionally one or more additional dispersants. The first specified dispersant is at least one condensation product of a fatty hydrocarbyl monocarboxylic acylating agent, such as a fatty acid, with an amine or ammonia.

The hydrocarbyl portion of the fatty hydrocarbyl monocarboxylic acylating agent can be an aliphatic group. The aliphatic group can be linear, branched, or a mixture thereof. The aliphatic group can be saturated, unsaturated, or a mixture thereof. The aliphatic group can have 1 to 50 carbon atoms, in another instance 2 to 30 carbon atoms, and in a further instance 4 to 22 carbon atoms, preferably 8, 10, or 12 to 20 carbon atoms. If the fatty hydrocarbyl moncarboxylic acylating agent is an aliphatic carboxylic acid, it may be seen as comprising a carboxy group (COOH) and an aliphatic group. Thus, the total number of carbon atoms in the carboxylic acid can be 2 to 52, or 3 to 30, or 5 to 23, or 9, 11, or 13 to 21. The monocarboxylic acylating agent can be a monocarboxylic acid or a reactive equivalent thereof, such as an anhydride, an ester, or an acid halide such as stearoyl chloride. Useful monocarboxylic acylating agents are available commercially from numerous suppliers and include tall oil fatty acids, oleic acid, stearic acid and isostearic acid. Fatty acids containing 12 to 24 carbon atoms, including C18 acids, are particularly useful.

The amine can be a monoamine, a polyamine, an alkanolamine, a thiol-containing amine, or a mixture thereof. In order to be suitably reactive, the amine should contain at least one primary or secondary amine nitrogen atoms, unless another reactive moiety, such as an OH group, is also present. The condensation product can be amide, in the case of a monoamine or an amide and/or ester and/or heterocyclic reaction product in the case of an alkanolamine, and an amide and/or heterocyclic reaction product in the case of a polyamine.

The amine can be a monoamine having one amine group and includes primary and secondary monoamines such as methylamine and dimethylamine. The monoamine can have 1 to 30 carbon atoms or 2 to 18 or 3 to 12 carbon atoms.

The amine can be a polyamine having two or more amine groups where a first amine group is a primary amine group and a second amine group is a primary or secondary amine group. The reaction product of the monocarboxylic acylating agent and the polyamine can contain, in greater or lesser amounts depending on reaction conditions, a heterocyclic reaction product such as 2-imidazoline reaction products. The polyamine can have 2 to 30 carbon atoms. The polyamine can include alkylenediamines, N-alkyl alkylenediamines, and polyalkylenepolyamines. Useful polyamines include ethylenediamine, 1,2-diaminopropane, N-methylethylenediamine, N-tallow($C_{16}$-$C_{18}$)-1,3-propylenediamine, N-oleyl-1,3-propylenediamine, polyethylenepolyamines such as diethylenetriamine and triethylenetetramine and tetraethylenepentamine and polyethylenepolyamine bottoms.

In an embodiment of the invention the amine is a polyamine. In another embodiment of the invention the monocarboxylic acylating agent and the polyamine are respectively a $C_4$ to $C_{22}$ fatty carboxylic acid and an alkylenediamine or a polyalkylenepolyamine, and in a further embodiment the fatty carboxylic acid is isostearic acid and the polyamine is a polyethylenepolyamine such as tetraethylenepentamine.

The amine can also be an alkanolamine having at least one amine group and at least one hydroxyl group, where the amine group is a primary, secondary or tertiary amine group. The alkanolamine can have 2 to 30 carbon atoms. The alkanolamine can include mono-, di- and trialkoxylates of ammonia such as mono- and di- and triethanolamine, hydroxy-containing monoamines such as a diethoxylated $C_{16}$ to $C_{18}$ tallowamine, and hydroxy-containing polyamines such as 2-(2-aminoethylamino)ethanol. In one embodiment the alkanolamine can react with the monocarboxylic acylating agent to form a reaction product that comprises a heterocyclic reaction product such as 2-oxazoline and 2-imidazoline reaction products. The alkanolamine can have at least one hydroxyl group and at least one amine group where at least one amine group is a primary amine group, or it can have at least one hydroxyl group and at least two amine groups where one of the amine groups is a primary amine group and a second amine group is a primary or secondary amine group. The alkanolamine can have 2 to 30 carbon atoms and can include hydroxy-containing monoamines such as ethanolamine and tris(hydroxymethyl)aminomethane, as well as hydroxy-containing polyamines such as 2-(2-aminoethylamino)ethanol.

The amine can also be a thiol-containing amine having at least one thiol group and at least one amine group where the amine group can be a primary, secondary or tertiary amine group. The thiol-containing amine can have 2 to 30 carbon atoms and can include thiol-containing monoamines and thiol-containing polyamines such as 2-aminoethanethiol and 2-(dimethylamino)ethanethiol.

The monocarboxylic acylating agents and amines are commercially available. Their condensation products can generally be prepared by forming a mixture thereof at ambient to elevated temperatures of 50 to 200° C., and heating the mixture at elevated temperatures of 100 to 300° C. until the reaction product is formed in a satisfactory amount, as is more completely described in the reaction procedures in columns 37 and 39 of U.S. Pat. No. 4,724,091.

The amount of the condensation product of the monocarboxylic acylating agent and the amine or ammonia is 0.5 to 8 percent by weight of the lubricating composition, preferably 1 to 6 percent, or 2 to 5 percent or 2.5 to 5 percent.

The second specified dispersant is a Mannich dispersant, sometimes referred to as a Mannich base dispersant. Mannich dispersant is a reaction product of a hydrocarbyl-substituted phenol, an aldehyde, and an amine or ammonia. The hydrocarbyl substituent of the hydrocarbyl-substituted phenol can have 10 to 400 carbon atoms, in another instance 30 to 180 carbon atoms, and in a further instance 10 or 40 to 110 carbon atoms. This hydrocarbyl substituent can be derived from an olefin or a polyolefin. Useful olefins include alpha-olefins, such as 1-decene, which are commercially available.

The polyolefins which can form the hydrocarbyl substituent can be prepared by polymerizing olefin monomers by well known polymerization methods and are also commercially available. The olefin monomers include monoolefins, including monoolefins having 2 to 10 carbon atoms such as ethylene, propylene, 1-butene, isobutylene, and 1-decene. An especially useful monoolefin source is a $C_4$ refinery stream having a 35 to 75 weight percent butene content and a 30 to 60 weight percent isobutene content. Useful olefin monomers also include diolefins such as isoprene and 1,3-butadiene. Olefin monomers can also include mixtures of two or more monoolefins, of two or more diolefins, or of one or more monoolefins and one or more diolefins. Useful polyolefins include polyisobutylenes having a number average molecular weight of 140 to 5000, in another instance of 400 to 2500, and in a further instance of 140 or 500 to 1500. The polyisobutylene can have a vinylidene double bond content of 5 to 69%, in a second instance of 50 to 69%, and in a third instance of 50 to 95%. The polyolefin can be a homopolymer prepared from a single olefin monomer or a copolymer prepared from a mixture of two or more olefin monomers. Also possible as the hydrocarbyl substituent source are mixtures of two or more homopolymers, two or more copolymers, or one or more homopolymers and one or more copolymers.

The hydrocarbyl-substituted phenol can be prepared by alkylating phenol with an olefin or polyolefin described above, such as a polyisobutylene or polypropylene, using well-known alkylation methods.

The aldehyde used to form the Mannich dispersant can have 1 to 10 carbon atoms, and is generally formaldehyde or a reactive equivalent thereof such as formalin or paraformaldehyde.

The amine used to form the Mannich dispersant can be a monoamine or a polyamine, including alkanolamines having one or more hydroxyl groups, as described in greater detail above. Useful amines include those described above, such as ethanolamine, diethanolamine, methylamine, dimethylamine, ethylenediamine, dimethylaminopropylamine, diethylenetriamine and 2-(2-aminoethylamino)ethanol. The Mannich dispersant can be prepared by reacting a hydrocarbyl-substituted phenol, an aldehyde, and an amine as described in U.S. Pat. No. 5,697,988. In an embodiment of this invention the Mannich reaction product is prepared from an alkylphenol derived from a polyisobutylene, formaldehyde, and an amine that is a primary monoamine, a secondary monoamine, or an alkylenediamine, in particular, ethylenediamine or dimethylamine.

The amount of the Mannich dispersant is 0.5 to 8 percent by weight of the lubricating composition, preferably 1 to 6 percent, or 2 to 5 percent or 2.5 to 5 percent.

Optionally, one or more additional dispersants may be present, other than the condensation products and the Mannich dispersant described above. If present, the additional dispersant will typically be present in an amount of 0.5 to 8 percent by weight of the lubricating composition, preferably 1 to 6 percent, or 2 to 5 percent or 2.5 to 5 percent. The total amount of all the dispersants in the lubricant composition will be at least 1.5 percent by weight, preferably at least 2 or 3 percent by weight. The upper limit on the amount of dispersants is not particularly fixed, but practically will likely not exceed 24 percent or 20 percent or 16 or 12 percent by weight of the composition. (These amounts are on an active chemical basis, excluding diluent oil.)

Other dispersants are well known and include alkyl amino phenol dispersants, succinimide dispersants, hydrocarbyl-amine dispersants, polyether dispersants, and coupled phenol dispersants.

Alkyl amino phenol dispersants are hydrocarbyl-substituted aminophenols. The hydrocarbyl substituent of the aminophenol can have 10 to 400 carbon atoms, in another instance 30 to 180 carbon atoms, and in a further instance 10 or 40 to 110 carbon atoms. The hydrocarbyl substituent can be derived from an olefin or a polyolefin, as described above in connection with the Mannich dispersant. The hydrocarbyl-substituted aminophenol can have one or more hydrocarbyl substituents but generally has a single hydrocarbyl substituent. The hydrocarbyl-substituted aminophenol can have one or more amino groups, in another instance can have two amino groups, and in a further instance can have a single amino group. The amino group of the aminophenol can be represented by the formula —$NH_2$. The hydrocarbyl-substituted aminophenol can be prepared by alkylating phenol with an olefin or a polyolefin, nitrating the alkylated phenol with a nitrating agent such as nitric acid, and reducing the nitrated phenol with a reducing agent such as hydrazine at temperatures of 100 to 200° C. or with a metal catalyzed hydrogenation as described in U.S. Pat. No. 4,724,091.

Succinimide dispersants are N-substituted long chain alkenyl succinimides, having a variety of chemical structures including typically

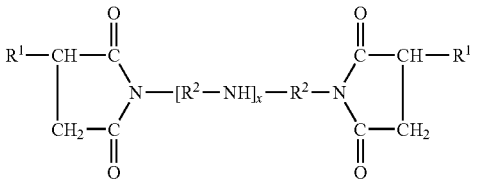

where each $R^1$ is independently an alkyl group (which may be substituted by more than one succinimide group), frequently a polyisobutyl group with a molecular weight of 500-5000, and $R^2$ are alkenyl groups, commonly ethylenyl ($C_2H_4$) groups. Such molecules are commonly derived from reaction of an alkenyl acylating agent with an amine, including monoamines, polyamines (illustrated in the above formula), and hydroxyamines, as described in greater detail above; and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892. Preferred succinimide dispersants include mono-succinimide dispersants that is, for example, a succinimide detergent containing one or substantially only one polyisobutene-substituted succinic group per polyamine moiety. Such materials can contain up to 10% of molecules containing more than one substituted succinic group per polyamine molecule, preferably up to 5%, and more preferably up to 3% or 2% or 1%. Such materials can be prepared by reacting a substituted succinic anhydride with a restricted amount of polyamine, as described in WO 02/102942.

Hydrocarbyl-amine dispersants are hydrocarbyl-substituted amines. The hydrocarbyl substituent of the amine can be the same as described above for the hydrocarbyl substituent of the Mannich dispersant. In an embodiment of the invention the hydrocarbyl substituent of the hydrocarbyl-amine dispersant is a polyisobutylene having a number average molecular weight of 140 to 5600, in a second instance of 420 to 2500, and in a third instance of 140 or 560 to 1540. The amine of component, which is substituted by the hydrocarbyl group, can be derived from ammonia, a monoamine, or a polyamine where the monoamine or polyamine can be an alkanolamine containing at least one hydroxyl group. Useful amines include ethylamine, dimethylamine, ethanolamine, ethylenediamine, 2-(2-aminoethylamino)ethanol, and polyethylenepolyamines such as diethylenetriamine. The hydrocarbyl-substituted amine can be formed by heating a mixture of a chlorinated olefin or polyolefin such as a chlorinated polyisobutylene with an amine such as ethylenediamine in the presence of a base such as sodium carbonate as described in U.S. Pat. No. 5,407,453.

Polyether dispersants include polyetheramines, polyether amides, polyether carbamates, and polyether alcohols. Polyetheramines can be represented by the formula $R[OCH_2CH(R^1)]_nA$, where R is a hydrocarbyl group, $R^1$ is hydrogen or a hydrocarbyl group of 1 to 16 carbon atoms, or mixtures thereof, n is 2 to 50, and A can be —$OCH_2CH_2CH_2NR^2R^2$ or —$NR^3R^3$, where each $R^2$ is independently hydrogen or hydrocarbyl and each $R^3$ is independently hydrogen, hydrocarbyl, or an alkyleneamine group. Polyetheramines and their methods of preparation are described in greater detail in U.S. Pat. No. 6,458,172, columns 4 and 5. Various Polyetheramides and polyethercarbamates can be prepared by reacting a polyether chain (derived from an alcohol and an alkylene oxide) with a reagent of appropriate functionality, again as described in the same U.S. Pat. No. 6,458,172. Polyether alcohols include hydrocarbyl-terminated poly(oxyalkylene) monools, including the hydrocarbyl-terminated poly(oxypropylene) monools described in greater detail in U.S. Pat. No. 6,348,075; see in particular column 8. The hydrocarbyl group can be an alkyl or alkyl-substituted aromatic group of 8 to 20 carbon atoms, such as $C_{12-16}$ alkyl or nonylphenyl.

Coupled phenol dispersants are hydrocarbylphenols (e.g., alkylphenols, the alkyl group containing, e.g., 30 to 300 carbon atoms) which have been coupled by reaction with an aldehyde such as formaldehyde or with sulfur or a source of sulfur. Alkylene-linked hydrocarbyl phenols are described in U.S. Pat. No. 4,724,091, see especially col. 12, bottom, and col. 13.

The Solvent

Another material commonly (but not necessarily) present in such lubricant compositions is a solvent, to aid in the solubility of the additives in the lubricant or in the fuel with which it is conventionally to be mixed. Typically such a material is a combustible solvent (other than oil of lubricating viscosity), having a flash point of less than about 105° C., in which the remaining components of the lubricant are soluble. The solvent is typically a hydrocarbonaceous solvent, that is, one which exhibits principally hydrocarbon character, even though relatively small numbers of heteroatoms may be present in the molecule. The solvent is preferably a hydrocarbon, and preferably having predominantly non-aromatic (e.g., alkane) character. The solvent thus preferably comprises less than 20 percent by weight aromatic components and is preferably substantially free from polynuclear aromatic components. (Aromatic hydrocarbons, in sufficiently large quantity, may contribute to smoke upon combustion and are thus sometimes less desirable.) A particularly suitable solvent is kerosene, which is a non-aromatic petroleum distillate having a boiling range of 180-300° C. Another useful solvent is Stoddard solvent, which has a boiling range of 154-202° C.

The solvent is characterized by a kinematic viscosity of less than 2 $mm^2s^{-1}$ (cSt) at 100° C., preferably less than 1.5 or 1.0 $mm^2s^{-1}$. Thus they are of lower viscosity than the oils of lubricating viscosity also employed in the invention.

The amount of the solvent is typically up to 45 percent by weight of the lubricant composition, preferably up to 40 or 35 or 30 percent. Often at least 20 or 25 percent solvent is present.

The Antioxidant

Another material commonly present is an antioxidant. Antioxidants include a variety of types of chemicals, including prominently hindered phenols and aromatic amines.

Antioxidants include hindered phenols represented by the formula:

(II)

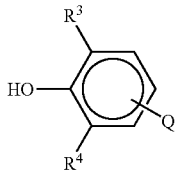

wherein $R^3$ and $R^4$ are independently branched or linear alkyl groups containing about 1 to 24, preferably 4 to 18, and most preferably 4 to 12 carbon atoms. $R^3$ and $R^4$ can be either straight or branched chain; branched is preferred. Preferably the phenol is butyl substituted containing two t-butyl groups. When the t-butyl groups occupy the 2,6-positions, the phenol is sterically hindered. Q is hydrogen or hydrocarbyl. Examples of suitable hydrocarbyl groups include 2-ethylhexyl, n-butyl, dodecyl or mixtures thereof.

Other optional sterically hindered phenols suitable for the invention include those represented by the formulae:

(III)

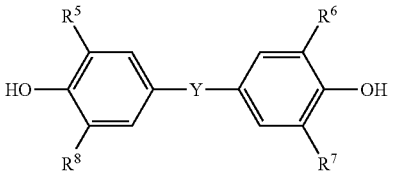

(IV)

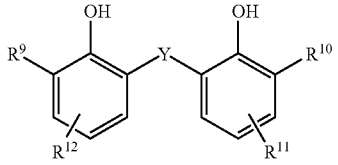

wherein $R^5$, $R^6$, $R^7$, $R^8$, $R^9$, $R^{10}$ are either straight or branched chain and contain 4 to 18, preferably 4 to 12 carbon atoms. Preferably the phenol is butyl substituted. $R^{11}$ and $R^{12}$ are independently hydrogen or hydrocarbyl; preferably $R^{11}$ and $R^{12}$ are arylalkyl or alkyl groups. The alkyl groups can be linear or branched, linear being preferred. $R^{11}$ and $R^{12}$ are preferably in the para position. The arylalkyl or alkyl groups typically contain 1 to 15, preferably 1 to 10, and more preferably 1 to 5 carbon atoms. The bridging group Y includes —$CH_2$— (methylene bridge) or —$CH_2OCH_2$— (ether bridge).

Examples of methylene-bridged sterically hindered phenols include 4,4'-methylenebis(6-tert-butyl o-cresol), 4,4'-methylenebis(2-tert-amyl-o-cresol), 2,2'-methylenebis(4-methyl-6-tert-butylphenol), 4,4'-methylene-bis(2,6-di-tert-butylphenol) and mixtures thereof.

In one embodiment the antioxidant is a hindered ester-substituted phenol represented by the formula:

(V)

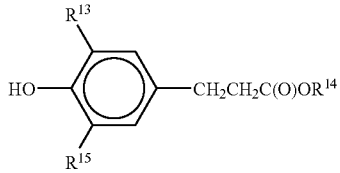

wherein $R^{13}$, $R^{14}$ and $R^{15}$ are straight or branched alkyl group containing 2 to 22, preferably 2 to 18, more preferably 4 to 8 carbon atoms. Specific examples include of alkyl groups include 2-ethylhexyl or n-butyl ester, dodecyl and mixtures thereof.

Another class of antioxidant is alkylated diphenylamines that can be represented by the following formula:

(VI)

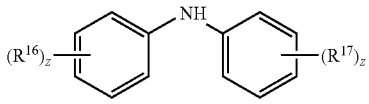

wherein $R^{16}$ and $R^{17}$ are independently hydrogen or hydrocarbyl, preferably arylalkyl or alkyl groups. The arylalkyl groups contain 5 to 20, preferably 6 to 10 carbons atoms. The alkyl groups can be linear or branched, preferably linear; the alkyl group contains 1 to 24, preferably 2 to 18 and most preferably 4 to 12 carbon atoms; and z is independently 0, 1, 2, or 3, provided that at least one aromatic ring contains a hydrocarbyl group. Preferred alkylated diphenylamines include bis-nonylated diphenylamine and bis-octylated diphenylamine or mixtures thereof.

The amount of the antioxidant is typically up to 3 percent by weight of the lubricating composition, or 0.5 to 2%, or 0.8 to 1.5%.

Other Components

Any of the compositions of the present invention may also contain a metal detergent. Metal detergents are typically overbased materials, otherwise referred to as overbased or superbased salts, which are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms, typically as one or more hydrocarbyl substituents, to provide a degree of solubility in oil. Useful metal detergents for the present invention will typically be neutral salts or will have a metal ratio (ratio of metal to acid group, a measure of excess base) of less than 2.

Suitable metal detergents include:

1.) Ca or Mg sulfonates, neutral or overbased;
2.) Ca or Mg phenates, preferably neutral but optionally overbased;
3.) Na, Ca, or Li glyoxylates, preferably neutral but optionally overbased;
4.) Ca, Mg, or Na salicylates, preferably neutral but optionally overbased;
5.) Ca or Mg saligenin products, preferably neutral, as described in U.S. Pat. No. 6,310,990, but optionally overbased;
6.) Metal calixarates, as described for instance, in U.S. Pat. No. 6,174,844, neutral or overbased;
7.) Crown ethers, that is, cyclic ethers in which the oxygen atoms coordinate with a metal ion, neutral or overbased.

Other conventional components may also be present, including olefin polymers such as polyisobutylene of relatively low molecular weight (e.g., 5000 or less, such as 500 to 2000, especially about 1000); pour point depressants; friction modifiers such as fatty esters; bright stock; viscosity index modifiers; metal deactivators; rust inhibitors, high pressure additives, anti-wear additives, and antifoam agents. Any of these materials can be present or can be eliminated, if desired.

The compositions of the present invention can be prepared by mixing the indicated components directly, or by preparing one or more of the components in the form of a concentrate, to which other components (such as oil or solvent) can subsequently be added.

The present invention also provides a method of lubricating a DFI two-stroke engine, comprising supplying a lubricant composition either to the crankcase of said engine or directly injecting the lubricant into the combustion chamber, or both, and operating said engine; wherein said lubricant composition is as defined above. The lubricant may be supplied undiluted as defined above, pre-diluted with fuel, or injected into the fuel flow before the transfer port.

In one embodiment, the lubricant composition of the present invention comprises the following:

(a) a major amount of oil of lubricating viscosity (b) an additive package present in an amount of 4-25% (amount including conventional diluent oils), containing the following dispersants:

1.) a Mannich base, for example, a high-vinylidene polybutene-substituted phenol reacted with formaldehyde and ethylenediamine;
2.) an alkyl amino phenol, for example, 4-polybutenyl-2-aminophenol, where the polybutenyl group has a number average molecular weight of about 1000; and
3.) a condensation product of a fatty acid such as isostearic acid with a polyamine such as tetraethylenepentamine (believed to contain an imidazoline component);

(c) a combustible solvent, such as kerosene or Stoddard solvent, present at levels of 0-35%, said solvent having a viscosity less than 2.0 cSt at 100° C. and preferably less than 1.5 or 1 cSt at 100° C.; and (d) an anti-oxidant, for example, an aromatic amine, in an amount of 0-3%.

In another embodiment, the present invention also provides a lubricant composition as set forth above, but wherein the combination of dispersants contains:

1.) a Mannich base;
2.) a condensation product of a fatty acid with a polyamine; and
3.) PIB polyamine, for example, the reaction product of a polyisobutene ($\overline{M}_n$ 1300) with ethylenediamine, by way of a chlorinated polyisobutene intermediate.

In each of the above formulations, the amounts of dispersants 1, 2, and 3 can be, in one instance 5-6% of the composition (including diluent oil, if any). More generally, each of the dispersants can comprise 20-50% of the dispersant mixture. Since dispersants typically will contain up to about 50% diluent oil, the amount as expressed on an active chemical basis will be correspondingly reduced. Typical amount of diluent oils are illustrated in the examples which follow.

EXAMPLES

The invention will be further illustrated by the following examples, which set forth the particularly advantageous method embodiments. While the Examples are provided to illustrate the present invention, they are not intended to limit it.

Oils are evaluated by running in a commercial DFI outboard engine. These engines are either of the Orbital™ or Ficht™ type, that is, sourced from or of the design from Orbital Engine Corporation Limited or Bombardier Inc., respectively. Testing is carried out along the guidelines supplied by and in conjunction with the engine OEMs. Testing includes a series of engines on boats in the field and a second series of engines tested in a large tank under controlled conditions.

1. Example 1 is an oil comprising the following:
   a. Polybutenyl amino phenol at 6.6% (60% chemical, 40% diluent oil)
   b. Condensation product of isostearic acid and tetraethylenepentamine at 4% (no diluent oil)
   c. Mono-succinimide as described above at 6.2% (70% chemical, 30% diluent oil)
   d. Aromatic amine anti-oxidant at 1.0%
   e. Glycerol monooleate (friction modifier) at 0.3%
   f. Rust inhibitor at 0.06%
   g. Solvent at 28%
   h. Polyisobutene, $\overline{M}_n$ about 1000, at 5% (no diluent oil)
   i. Base oil at 48.8%
2. Example 2 is an oil comprising the following:
   a. Alkyl amino phenol (as in Ex. 1) at 4.97% (60% chemical)
   b. Condensation product (as in Ex. 1) at 5.03%
   c. Mono-succinimide (as in Ex. 1) at 5.0% (70% chemical)
   d. Solvent at 28%
   e. Polyisobutene at 5%
   f. Base oil at 52%
3. Example 3 is an oil comprising the following:
   a. Alkyl amino phenol (as in Ex. 1) at 6.0% (60% chemical)
   b. Condensation product (as in Ex. 1) at 5%
   c. Mannich base as described above at 5% (67% chemical, 34% diluent oil)
   d. Na salt of alkyl phenol/glyoxylic acid reaction product, TBN (total base number) 51 at 0.6% (60% chemical, 40% diluent oil)
   e. Aromatic amine anti-oxidant at 1.0%
   f. Glycerol monooleate at 0.34% g. Rust inhibitor at 0.06%
h. Solvent at 28%
i. Polyisobutene at 8%
j. Base oil at 48%

The composition of Example 3 is derived using a two cycle formulation optimization tool, designed to assist formulators with the creation of new products that can meet or exceed specified performance targets. Regression models (e.g., linear or piecewise linear) are created relating formulating variables to performance test results in the Westbend™ 134 engine and the Yamaha™ YZ125 engine. Examples of formulating variables include chemical additive amounts, chemical/physical properties of the blend, and base oil descriptors. The regression models are created using a Bayesian model averaging algorithm (as described in Meyer, R. Daniel, and Wilkinson, Robert G. (1998), "Bayesian variable assessment," *Communications in Statistics, Part A—Theory and Methods,* 27, 2675-2705), along with standard statistical modeling practices. The models are then incorporated into a web-based optimization tool. The user of the tool specifies a choice of base fluid system along with a set of chemical additives to consider. The user can also specify treat rate constraints, a total cost constraint, and minimal performance targets on the Westbend™ 134 and/or Yamaha™ YZ125 tests. Using linear programming techniques, the system finds the optimal formulation that satisfies these requirements. The optimal formulation is one that either minimizes cost, or maximizes performance on one aspect of the above mentioned performance tests. This choice of optimality (i.e., the objective function) is chosen by the user of the tool. The additive composition in Example 3 above is tested in the Westbend™ and Yamaha™ in-house engines and a comparison of the predicted and actual test results for piston varnish, ring stick and piston crown deposits is shown in the following table, where the results are expressed in merit rating units on a scale of 1 to 10, 10 being extremely clean and 1 extremely dirty.

| | Predicted Results | Actual Test Results |
|---|---|---|
| Westbend ™ Piston Varnish | 8.78 | 9.00 |
| Westbend ™ Ring Stick | 8.31 | 7.43 |
| Yamaha ™ Piston Varnish | 8.57 | 8.25 |
| Yamaha ™ Ring Stick | 9.27 | 9.00 |
| Yamaha ™ Piston Crown Deposits | 8.75 | 8.70 |

Actual test results are very similar to the predicted values in all of the rated parameters shown above. The only exception to this is the Westbend™ ring stick rating, where the actual result is a bit lower than predicted.

Testing of the compositions or method described above is carried out by the following test procedures:

Procedure No. 1

Field testing is conducted using outboard engines in the following manner:

1. All engines/power heads have direct fuel injection systems of either the Orbital™ or Ficht™ designs. Engines are new or rebuilt by an OEM certified mechanic and vary in size from 86.8 kW to 168 kW (115 HP to 225 HP).
2. Engines are equipped with standard variable ratio oiling (VRO) systems.
3. Lubricants are supplied in sealed containers and clearly labeled and used to replenish the VRO systems.
4. Engines are installed outboard on the transom of open hull boats from 5.5 to 8.5 m (18 to 28 feet) in length.
5. Boats are operated as part of a commercial fleet with no restriction as to throttle range or environmental conditions; i.e., normal operation.
6. Hour meters and tachometers are utilized to assist in monitoring the test.
7. All engine maintenance and repairs comply with OEM guidelines and are recorded.
8. End-of-test (EOT) inspections are performed by OEM certified mechanics and certified raters.
9. Engine ratings comply with National Marine Manufacturers Association (NMMA) and Coordinating Research Council (CRC) guidelines.
10. At EOT, engine duty cycle breakdown and performance parameters are downloaded from the engine computer processing unit. Engine compression and operator comments are also noted.

Testing gives the following results using Procedure No. 1:

| Optimax 225 HP Engine* Test Results | OEM Oil A[a] | Example 1 Oil | Example 2 Oil |
|---|---|---|---|
| Piston Varnish | 8.8 | 9.1 | 8.6 |
| Top Ring Stick | 10 | 10 | 10 |
| Ring Groove Fill Nr. 1 | 12.5% | 0.5% | 13.2% |
| Ring Groove Fill Nr. 2 | 3.2% | 0.0% | 1.3% |
| Undercrown | 5.7 | 8.85 | 6.3 |
| Ring Land Deposits | 8.3 | 9.0 | 8.0 |
| Piston Crown Deposits; | 0.051 | 0.086 | 0.056 |
| measured mm (inches) | (0.0020) | (0.0034) | (0.0022) |
| Total Test Hours | 110 | 118.5 | 107.5 |

*Optimax ™ engines use the Orbital ™ DFI design and are manufactured by Mercury Marine.
[a]A premium high nitrogen-containing 2-cyle outboard oil from a major OEM, used as a reference example for this data set.

The results show that the formulations of Examples 1 and 2, which have low nitrogen content, yield performance equivalent to or better than the high-nitrogen containing OEM oil. Example 1 demonstrates enhanced performance as shown by the significant reduction in ring groove carbon and piston varnish. This enhanced performance will help prevent ring jacking and subsequent engine seizure. This oil also demonstrates a significant reduction in ring land and undercrown deposits, which enhances engine durability.

Procedure No. 2

Tank testing is conducted using outboard engines and the same procedure as described in Procedure No. 1, with the following exceptions:

1. Test engines are installed on a frame suspending the engine in a large steel tank filled with water held at a pre-determined temperature range, rather than on open-hull boats.
2. The engine duty cycle includes OEM break-in, high-speed high-load, and idle, all to simulate normal to severe engine operation.

Testing gives the following results using Procedure No. 2:

| Optimax 150 HP Engine* Test Results | OEM Oil B[b] | Example 1 Oil | Example 3 Oil |
|---|---|---|---|
| Piston Varnish | 8.8 | 8.6 | 7.0 |
| Average Piston Deposits | 6.1 | 6.4 | 6.0 |
| Top Ring Stick | 10 | 10 | 10 |

-continued

| Optimax 150 HP Engine* Test Results | OEM Oil B[b] | Example 1 Oil | Example 3 Oil |
|---|---|---|---|
| Top Ring Heavy Carbon | 6.4% | 3% | 0% |
| Second Ring Heavy Carbon | 7.7% | 1.2% | 0% |
| Undercrown | 3.5 | 4.9 | 8.4 |
| Ring Land Deposits | 6.2 | 6.4 | 3.6 |
| Total Test Hours | 50 | 50 | 50 |

*Optimax ™ engines use the Orbital DFI design and are manufactured by Mercury Marine.
[b]A high nitrogen-containing OEM oil designed and sold for enhanced DFI performance, used as a reference example for this data set.

The results show that Examples 1 and 3, which have low nitrogen content, yield performance equivalent or better than the high-nitrogen containing OEM oil. Both of these examples demonstrate enhanced performance by a very significant reduction in top and second ring heavy carbon. These reductions in deposits can prevent ring jacking and subsequent engine seizure.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character.

Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricant composition suitable for lubricating a direct fuel injection two-stroke engine, comprising:

(a) at least about 40 percent by weight of an oil of lubricating viscosity;

(b-1) 2.5 to about 8 percent by weight of at least one condensation product of a fatty hydrocarbyl monocarboxylic acid having about 12 to about 24 carbon atoms with a polyethylene polyamine, and (b-2) 0.5 to about 8 percent by weight, based on the lubricant composition, of at least one Mannich dispersant wherein the Mannich dispersant is the reaction product of a polybutene-substituted phenol, formaldehyde, and ethylenediamine or dimethylamine;

(c) 0 to about 45 percent by weight of a combustible solvent having a viscosity of less than 2 $mm^2s^{-1}$ (cSt) at 100° C.; and (d) 0.8 to about 2.0 percent by weight of an aromatic amine antioxidant;

provided that the total amount of (b-1) plus (b-2) plus any dispersants in the lubricant composition other than (b-1) and (b-2) is at least about 7.5 percent by weight and at most 12 percent by weight, further provided that the total nitrogen content in the lubricant composition is about 0.25 to about 0.75 percent by weight.

2. The lubricant composition of claim 1 further comprising (b-3) about 0.5 to about 8 percent by weight of at least one additional dispersant of a type other than (b-1) and (b-2).

3. The lubricant composition of claim 2 wherein the additional dispersant (b-3) is an alkyl amino phenol dispersant, a mono-succinimide dispersant, a hydrocarbyl-amine dispersant, a polyether dispersant, or a coupled phenol dispersant.

4. The lubricant composition of claim 1 wherein the condensation product of (b-1) is the condensation product of a fatty acid having about 12 to about 24 carbon atoms with a polyamine.

5. The lubricant composition of claim 4 wherein the fatty acid comprises isostearic acid and the polyamine comprises tetraethylenepentamine.

6. The lubricant of claim 1 admixed with a major amount of liquid fuel composition.

7. A method of lubricating a direct fuel injection two-cycle engine, comprising supplying the lubricant composition of claim 1 to the engine.

8. The method of claim 7 wherein the lubricant composition is admixed with a major amount of a liquid fuel composition, and the resulting mixture is supplied to the engine.

9. The lubricant composition of claim 1 wherein the amount of the Mannich dispersant (b-2) is about 5 to about 8 percent by weight.

10. A lubricant composition suitable for lubricating a direct fuel injection two-stroke engine, comprising:

(a) at least about 40 percent by weight of an oil of lubricating viscosity;

(b-1) 2.5 to about 8 percent by weight of at least one condensation product of a fatty hydrocarbyl monocarboxylic acid having about 12 to about 24 carbon atoms with a polyethylene polyamine, and (b-2) 0.5 to about 8 percent by weight, based on the lubricant composition, of at least one Mannich dispersant wherein the Mannich dispersant is the reaction product of a polybutene-substituted phenol, formaldehyde, and ethylenediamine or dimethylamine;

(d) 0.8 to about 2.0 percent by weight of an aromatic amine antioxidant;

provided that the total amount of (b-1) plus (b-2) plus any dispersants in the lubricant composition other than (b-1) and (b-2) is at least about 7.5 percent by weight and at most 12 percent by weight, further provided that the total nitrogen content in the lubricant composition is about 0.25 to about 0.75 percent by weight.

* * * * *